US005146956A

United States Patent [19]

Burgos et al.

[11] Patent Number: 5,146,956

[45] Date of Patent: Sep. 15, 1992

[54] PROGRAMMABLE CONTROLLED WINDER

[75] Inventors: Iris Burgos, Wilmington, Del.; Leroy Dunn, Coatesville, Pa.; Altan Husni, Middletown, Del.

[73] Assignee: Slocomb Industries, Inc., Wilmington, Del.

[21] Appl. No.: 564,592

[22] Filed: Aug. 9, 1990

[51] Int. Cl.[5] ..... B21F 9/00

[52] U.S. Cl. ..... 140/89; 81/486

[58] Field of Search ..... 140/89, 115, 119, 149; 29/225, 227; 81/486; 173/163

[56] References Cited

U.S. PATENT DOCUMENTS

| | | | |
|---|---|---|---|
| 1,635,747 | 7/1927 | Folger et al. | 81/486 |
| 3,026,915 | 3/1962 | Jones et al. | 140/119 |
| 3,561,502 | 2/1971 | Swaisgood | 140/115 |
| 3,787,956 | 1/1974 | Miller | 29/227 |
| 4,132,250 | 1/1979 | Brown et al. | 140/115 |

*Primary Examiner*—Lowell A. Larson
*Attorney, Agent, or Firm*—Connolly & Hutz

[57] ABSTRACT

Various structures exist which require an element to be turned in a certain direction. The turning is accomplished by a programmable controlled winder which includes a motor driven tool in association with a computer for automatically stopping the rotation after a pre-set number of rotations have been made.

22 Claims, 2 Drawing Sheets

Fig. 2.
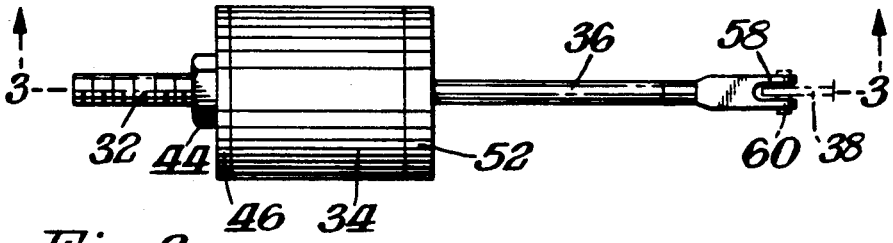
Fig. 4.
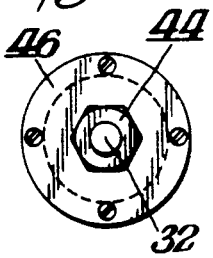
Fig. 3.
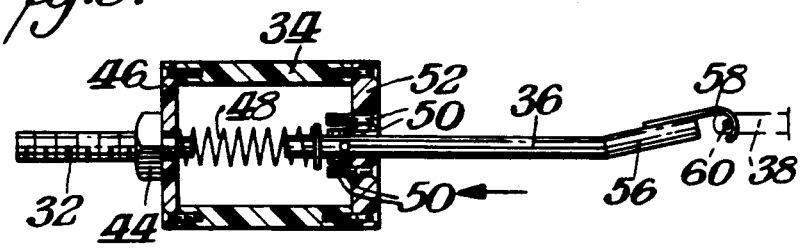
Fig. 5.
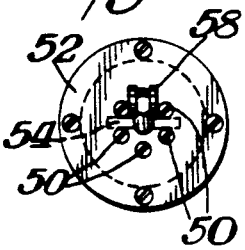
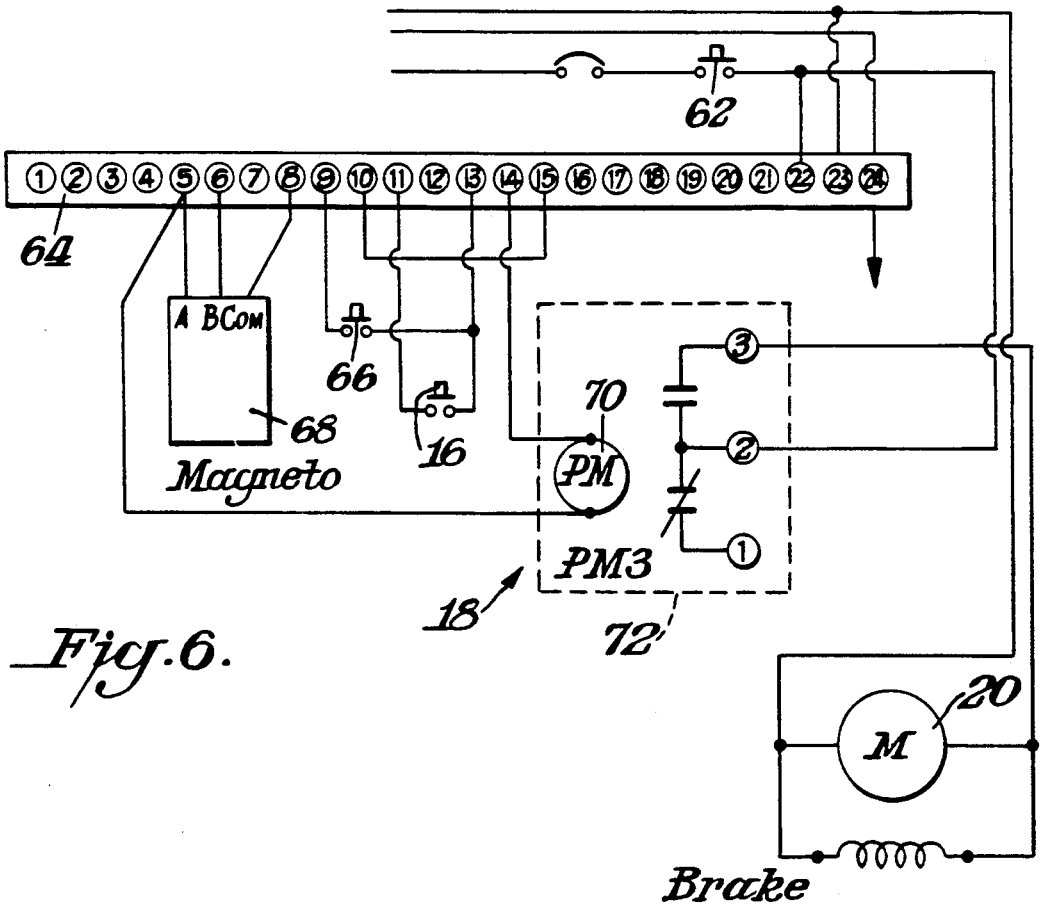
Fig. 6.

PROGRAMMABLE CONTROLLED WINDER

BACKGROUND OF INVENTION

Various applications require an element to be turned a specific number of times in either direction. Such applications include spiral type balance winders, window shade spring tensioners, spring tensioners (spiral type) and coil springs. For example, tilt windows are conventionally made of extruded plastic material wherein the frame is hollow. Generally, a balance is provided for the window comprised of a tubular casing secured at one end to an end of a frame member. A spring is anchored to the secured end within the casing and the spring in turn is attached to a spiral bar. In the manufacture of such windows, tension is imparted to the spring by rotating the bar a fixed number of times. The exact number of times would vary with different window constructions. It is necessary, however, in order to obtain the proper amount of tension that the exact number of rotations be made. Conventionally, the rotating of the bar is accomplished by a manually operated hand tool. In this procedure the operator must carefully count the number of rotations so that the preset number will be accurately obtained. This presents problems where the operator is distracted or may not be completely attentive. The responsibility of having to keep an accurate track of the number of rotations also creates a stressful working condition. It would, therefore, be desirable if some means could be achieved for rotating the bar and tensioning the spring in an automatic manner, without requiring the operator to keep track of the number of rotation.

SUMMARY OF INVENTION

An object of this invention is to provide a programmable controlled winder which may be automatically performed by an operator.

A further object of this invention is to provide such a winder wherein the rotation is accomplished by motorized means and is automatically stopped when the preset number of rotations is achieved.

In accordance with this invention, the tension is provided by a winder which includes a hand held tool having a bit for being temporarily locked to the element to be turned. The tool is rotated by a motor associated with a computer. By means of the computer the pre-set number of rotations can be initially entered and upon reaching that number of rotations a brake is actuated to stop the motor and thereby stop the number of rotations at precisely the correct amount.

In a preferred embodiment of this invention, the winder is activated by means of a conveniently located switch. Such switch can be foot operated, hand operated or located so that it can be actuated by the knee of the operator.

THE DRAWINGS

FIG. 2 is a side elevation view of the tool holder and bit in the winder shown in FIG. 1;

FIG. 3 is a cross-sectional view taken through FIG. 2 along the line 3—3;

FIG. 4 is a rear elevation view of the tool holder shown in FIGS. 2-3;

FIG. 5 is a front elevation view of the tool holder and bit shown in FIGS. 2-3; and FIG. 6 is a schematic showing of the computer included in the winder shown in FIG. 1.

DETAILED DESCRIPTION

Figure 1:
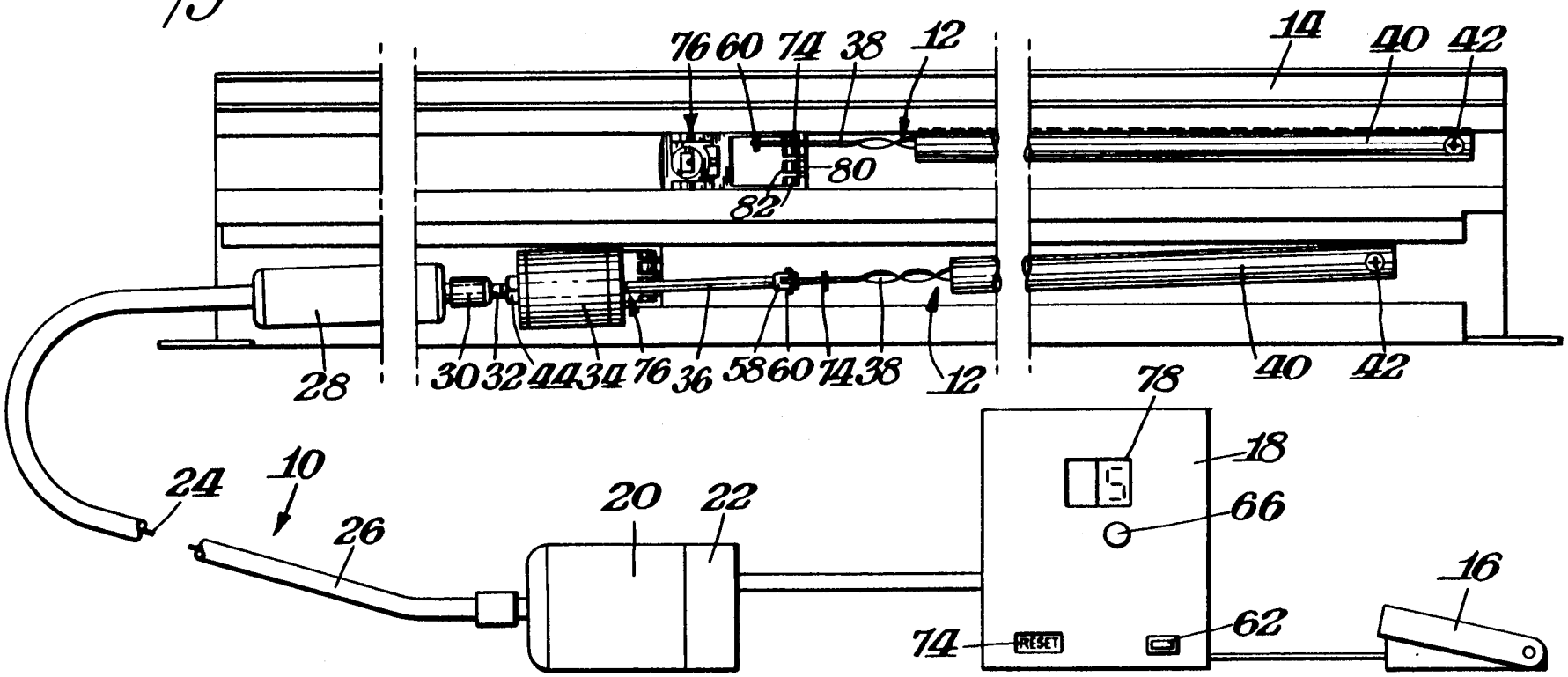
FIG. 1 is an elevation view schematically illustrating the components of the programmable controlled winder in accordance with this invention.

The invention relates to a winder in general. Such winder could be used for any application that needs a specific number of turns in either direction. These applications include spiral type balance winders, window shade spring tensioners, spiral type spring tensioners and coil springs. Specific description, however, will be had to the practice of the invention as used with extruded tilt windows. FIG. 1 illustrates a winder 10 in accordance with this invention for providing the proper tension to a balance 12 located in a portion of the window frame 14 of an extruded tilt window. Thus, in the illustrated embodiment winder 10 is a balance winder.

The balance winder 10 generally includes an actuating switch 16 connected to a computer 18, which in turn is connected to a motor 20 having a brake 22. A shaft 24 disposed within a flexible cable 26 extends to a hand piece 28. The hand piece includes a chuck 30 connected to threaded rod 32 in tool holder housing 34 from which tool bit 36 extends. Bit 36 is detachably connected to the exposed portion of balance bar 38. Bar 38 in turn is disposed within casing 40. Casing 40 is attached by a screw 42 or other suitable fastening device at its opposite end to frame member 14. A spring (not shown) is anchored at fastener 42 within casing 40 and is connected to the end of bar 38 within casing 40. The intent of the invention is to rotate bar 38 a preselected number of times and thereby impart tension to the spring as is necessary for such tilt windows. The structure of the balance and its need for rotation to obtain the proper tension is known in the art.

FIGS. 2-5 illustrate in greater detail tool holder housing 34 and its associates components. As shown therein, threaded rod 32 is mounted by nut 44 to an end wall 46 of housing 34. A portion of nut 32 extends internally of housing 34. Bit 36 also extends into housing 34 and the ends of rod 32 and bit 36 are connected by spring 48. Bit 36 is spring loaded in that spring 48 resiliently urges pin 54 connected to bit 36 toward contacting wall 52 of housing 34.

As best shown in FIGS. 3 and 5 a series of six equally spaced screws 50 extend through front wall 52 of housing 34. Bit 36 includes a pin 54 extending transversely through the shaft of bit 36. Pin 54 is dimensioned to fit between adjacent sets of screws 50. In this manner, screws 50 in association with pin 54 act as a stop to lock bit 36 with respect to housing 34. When it is desired to couple bit 36 to a bar 38 and if bit 36 is not in the proper angular orientation, bit 36 could be moved backwards toward wall member 46 until pin 54 has been axially shifted beyond screws 50 so that bit 36 can then be turned to its proper orientation. Bit 36 would then be locked in this orientation under the influence of spring 48 urging bit 36 forwardly until pin 54 is disposed against front face 52 between sets of adjacent screws 50.

The forward end of bit 36 includes an upwardly angled portion 56 which terminates in a bifurcation in the form of a pair of spaced hooks 58. Hooks 58 would be disposed over pin 60 at the end of bar 38. In this manner, bit 36 is detachably engaged with or locked to bar 38 and upon activation of the system, housing 34 would rotate thereby rotating bit 36 which in turn would cause bar 38 to be rotated.

FIG. 6 schematically illustrates the details of computer 18. It is to be understood that computer 18 may be of conventional construction. Computer 18 should have the capability of being able to preselect a number of rotations at the beginning of each operation. Additionally, computer 18 should have the capability of inactivating the motor and braking the motor when that preselected number of rotations has been achieved. Finally, computer 18 should have the capability of being reset so that any number of rotations can be selected at the beginning of an operation.

As shown in FIG. 6, computer 18 includes a main switch 62 which operates to turn the power on or off. A dynapar controller terminal board 64 is provided having a series of numbers indicated thereon. In accordance with the number of revolutions to be imparted to bar 38, the number of revolutions on board 34 is selected by preset advance 66 which is shown in FIG. 1 as a push button. Computer 18 also includes a magneto 68 which control the number of revolutions to count the processor which drives the motor 70 in relay module 72 which provides the power for motor 20. A reset 74 (see FIG. 1) is pushed to reset the numbering back to the smallest number which is indicated on board 64 as being one revolution. Accordingly, if two revolutions are desired preset advance button 66 would be pushed one additional time. If eight revolutions were desired, button 66 would be pushed seven times so that the base number one could be raised to the number eight. The brake 22 would be actuated when magneto 68 detects the desired number of revolutions being obtained. Motor 20 is actuated by start switch 16 which is indicated in FIG. 6 as a switch and which is shown in FIG. 1 as a foot operated switch located on the floor. If desired, start switch 16 can also be hand operated and located elevated such as on or above the work table. A particularly advantageous location for start switch 16, however, would be at the work station about two feet above the floor in the vicinity of the operator's knee so that it can be knee actuated.

Balance winder 10 operates in the following manner. Each twisted bar 38 is provided with a pair of pins 60,74. A slide block 76 on frame 14 is associated with each bar 38 and is coupled thereto after bar 38 has been rotated to achieve the proper tensioning. Accordingly, when the tensioning is being obtained by rotation of bar 38, slide block 76 is not yet coupled thereto as shown by the lower bar in FIG. 1. Thus, casing 40 may pivot about its pivot point 42 to a position best capable of having pin 60 engaged by hooks 58 of bit 36. Reset button 74 is pressed to move the setting on board 64 back to the number one. The number is visually displayed in panel 78 of computer 18. Button 66 is then pressed the proper number of times to raise the displayed number so that it indicates the number of revolutions for that particular balance. For example, as illustrated in FIG. 1 the number 5 is displayed. This would require pressing the button 66 four additional times so that the displayed number is raised from the original number one to the desired number five. Switch 16 is then actuated by the knee, foot or hand in accordance with the particular type of switch being used. This causes motor 20 to turn shaft 24 which in turn rotates rod 32 coupled to tool holder housing 34 so that housing 34 also rotates thereby causing bit 36 extending from housing 34 to rotate bar 38. When the preselected number of rotations is obtained brake 22 is actuated to stop the number of rotations instantaneously after the preselected number has been achieved so that the proper tension is imparted to the balance tensioner.

After the proper tension has been achieved hooks 58 are disengaged from pin 60 and bar 38 is coupled to slotted plate 80 of slide block 76 by pin 74 being engaged between selected sets of hooks 82. This condition is illustrated in the upper portion of FIG. 1.

When it is desired to again use the balance winder 10, bit 36 is reset to be in the proper orientation should such be necessary, as previously described. Bit 36 would then be coupled to the next bar 38 and the process would be repeated.

An advantageous feature of winder 10 is the ability to detach housing 34 from hand piece 28 by means of the detachable connection of member 32 with chuck 30. As a result, the same basic unit including the computer and hand piece can be used with different type of bits by replacing the housing and its bit in accordance with the particular type of balance tensioner.

It is within the concept of this invention to mount a plurality of bits to the same housing 34 so that multiple bars can be simultaneously rotated the same number of revolutions. The invention in its broadest form may also be practiced by having a pair of housings each with its own number of bits, preferably one bit for each housing, operated for simultaneously tensioning two or more different bars wherein the number of rotations need not be the same.

As can be appreciated, balance winder 10 provides a system whereby the proper tension can be achieved in an automatic manner without requiring the operator to mentally count the number of revolutions during the tensioning process. Accordingly, this assures the proper amount of tensioning in a virtually fail safe manner.

What is claimed is:

1. A winder for creating tension in a single element by rotating the single element a preselected number of times comprising a hand piece, a tool bit operatively connected to said hand piece, motor means operatively connected to said hand piece for rotating said tool bit, single element attaching means on said tool bit for detachable attachment to the single element for rotating the element, control means operatively connected to said motor means for preselecting the number of rotations of said tool bit and automatically halting the rotation when the preselected number has been reached, in combination therewith, a spiral balance in an extruded tilt window, said spiral balance being said single element, said attaching means being detachably attached to said spiral balance, said extruded tilt window having a hollow frame, and said spiral balance being in a portion of said frame.

2. The winder of claim 1 wherein said control means includes a computer.

3. The winder of claim 2 wherein said control means includes a rotation number selector and a reset for resetting the number.

4. The winder of claim 3 wherein said control means includes a visual display for indicating the preselected number.

5. The winder of claim 3 wherein said tool bit is detachably connected to said hand piece.

6. The winder of claim 3 wherein a brake is operated by said control means for stopping the rotation of said motor means.

7. The winder of claim 6 including an actuator for turning on said motor means.

8. The winder of claim 7 wherein said actuator is foot operated.

9. The winder of claim 7 wherein said actuator is knee operated.

10. The winder of claim 7 wherein said actuator is hand operated.

11. The winder of claim 7 wherein said tool bit is detachably connected to said hand piece.

12. The winder of claim 1 wherein said tool bit is detachably connected to said hand piece.

13. A winder for rotating an element a preselected number of times comprising a hand piece, a tool bit operatively connected to sand hand piece, motor means operatively connected to said hand piece for rotating said tool bit, attaching means on said tool bit for detachable attachment to the single element for rotating the element, control means operatively connected to said motor means for preselecting the number of rotations of said tool bit and automatically halting the rotation when the preselected number has been reached, said control means including a computer, said control means including a rotation number selector and a reset for resetting the number, a brake being operated by said control means for stopping the rotation of said motor means, an actuator for turning on said motor means, said tool bit being mounted to and extends from a front wall of a tool holder housing, a rod connected to a rear wall of said housing, and said rod being detachably mounted to said hand piece whereby said tool bit is thereby detachably connected to said hand piece.

14. The winder of claim 13 wherein said tool bit terminates at its free end in a bifurcation in the form of a pair of curved hooks which comprises said tool bit attaching means.

15. The winder of claim 14 wherein the end of said tool bit remote from said free end is slidably mounted in said front wall of said housing, a pin connected to said tool bit within said housing, resilient means in said housing urging said tool bit away from said housing until said pin contacts said front wall, stop means in said front wall for contacting said pin to prevent relative rotation of said tool bit with respect to said housing, and said tool bit being inwardly slidable against the force of said resilient means whereby said pin may be moved out of contact with said stop means to adjust the angular position of said tool bit.

16. A winder for rotating an element a preselected number of times comprising a hand piece, a tool bit operatively connected to sand hand piece, motor means operatively connected to said hand piece for rotating said tool bit, attaching means on said tool bit for detachable attachment to the single element for rotating the element, control means operatively connected to said motor means for preselecting the number of rotations of said tool bit and automatically halting the rotation when the preselected number has been reached, said tool bit being detachable connected to said hand piece, said tool bit being mounted to and extends from a front wall of a tool holder housing, a rod connected to a rear wall of said housing, and said rod being detachably mounted to said hand piece whereby said tool bit is thereby detachably connected to said hand piece.

17. The winder of claim 16 wherein said tool bit terminates at its free end in a bifurcation in the form of a pair of curved hooks which comprises said tool bit attaching means.

18. The winder of claim 17 wherein the end of said tool bit remote from said free end slidably mounted in said front wall of said housing, a pin connected to said tool bit within said housing, resilient means in said housing urging said tool bit away from said housing until said pin contacts said front wall, stop means in said front wall for contacting said pin to prevent relative rotation of said tool bit with respect to said housing, and said tool bit being inwardly slidable against the force of said resilient means whereby said pin may be moved out of contact with said stop means to adjust the angular position of said tool bit.

19. A method of rotating an extruded tilt window spiral balance a preselected number of times to provide proper tension to the balance in a portion of a hollow extruded window frame comprising the steps of selecting the preselected number of rotations of the balance by setting that number in a computer, attaching a tool bit to the balance while the balance is in the window frame, rotating a motor shaft detachably operatively connected to the tool bit to thereby rotate the tool bit and the balance, and automatically stopping the rotation when the preselected number of rotations is reached.

20. A winder for creating tension in a single element by rotating the single element a preselected number of times comprising a hand piece, a tool bit operatively connected to said hand piece, motor means operatively connected to said hand piece for rotating said tool bit, single element attaching means on said tool bit for detachable attachment to the single element for rotating the element, control means operatively connected to said motor means for preselecting the number of rotations of said tool bit and automatically halting the rotation when the preselected number has been reached, and said single element attaching means including at least one hook for fitting over the single element.

21. The winder of claim 20 wherein said single element attaching means includes two spaced hooks.

22. The winder of claim 21 in combination therewith, a spiral balance in an extruded tilt window, said spiral balance being said single element, said balance having a transverse pin, and said hooks being mounted over said pin.

* * * * *